US011401672B2

(12) United States Patent
Tamhane et al.

(10) Patent No.: US 11,401,672 B2
(45) Date of Patent: Aug. 2, 2022

(54) IMPELLER DESIGN FOR SNOW BLOWER

(71) Applicant: Caterpillar Inc., Deerfield, IL (US)

(72) Inventors: Pushkar N. Tamhane, Apex, NC (US); Paul A. Rousseau, Raleigh, NC (US); Lucas G. De Caroli, Cary, NC (US)

(73) Assignee: Caterpillar Inc., Peoria, IL (US)

( * ) Notice: Subject to any disclaimer, the term of this patent is extended or adjusted under 35 U.S.C. 154(b) by 508 days.

(21) Appl. No.: 16/252,205

(22) Filed: Jan. 18, 2019

(65) Prior Publication Data

US 2020/0232176 A1 Jul. 23, 2020

(51) Int. Cl.
*E01H 5/09* (2006.01)
*E01H 5/04* (2006.01)
*E01H 5/07* (2006.01)

(52) U.S. Cl.
CPC ..... *E01H 5/098* (2013.01); *E01H 5/045* (2013.01); *E01H 5/076* (2013.01)

(58) Field of Classification Search
CPC ..... E01H 5/09; E01H 5/098; E01H 5/045; E01H 5/076
See application file for complete search history.

(56) References Cited

U.S. PATENT DOCUMENTS 2,269,326 A * 1/1942 Wandscheer ..... E01H 5/096 37/248
2,381,017 A * 8/1945 Wandscheer ..... E01H 5/09 37/248
2,751,697 A * 6/1956 Bucher ..... E01H 5/04 37/251
3,267,594 A 8/1966 Mattson et al.
3,468,041 A 9/1969 Mattson et al.
3,484,962 A * 12/1969 Klapprodt ..... E01H 5/076 37/256
3,525,002 A 8/1970 Mattson et al.
4,391,052 A 7/1983 Guy, Jr.
5,127,174 A 7/1992 Takeshita
5,209,003 A * 5/1993 Maxfield ..... E01H 5/098 37/252
6,938,364 B2 * 9/2005 White, III ..... E01H 5/04 37/248
7,305,777 B2 * 12/2007 Kettering ..... E01H 5/04 37/213
8,291,623 B2 * 10/2012 Shirland ..... E01H 5/045 37/244
9,464,393 B2 10/2016 Mast et al.
9,708,782 B2 * 7/2017 Houle ..... E01H 5/045
2007/0062076 A1 3/2007 Majkrzak

* cited by examiner

*Primary Examiner* — Thomas B Will
*Assistant Examiner* — Joan D Misa
(74) *Attorney, Agent, or Firm* — Schwegman, Lundberg & Woessner

(57) ABSTRACT

An example snow blower machine includes a first stage snow mover and a second stage snow mover. Snow is received at an inlet opening of the first stage and expels snow to the discharge opening. In a second stage, an impeller chamber receives snow from the first stage. The impeller chamber extends from a snow receiving end proximate the discharge opening to a distal end rearward of the discharge opening. To receive expelled snow from the first stage and deliver the snow to a second discharge opening, an impeller rotatable around an impeller axis at a hub is disposed in the impeller chamber. The impeller may be rotated by an impeller motor having a motor body that is at least partially disposed within the hub.

18 Claims, 8 Drawing Sheets

IMPELLER DESIGN FOR SNOW BLOWER

TECHNICAL FIELD

The present disclosure is directed generally, but not by way of limitation, to a snow blower machine for moving snow, and more particularly, to an impeller and impeller motor of a snow blower machine.

BACKGROUND

Snow removal is a tedious and costly operation. Snow blowers enable removal and throwing of snow from one location to another. Snow blowers generally involve machines for removing snow from an area where it is not wanted, such as a driveway, sidewalk, roadway, railroad track, rink, runway, or house. Snow blowers may use one or two stages to remove or "blow" snow. Such snow blowing devices typically use either electric power, or a gasoline or diesel engine to energize the throwing or blowing of snow.

In a two-stage snow blower machine, two mechanisms move the snow; an auger feeds the snow to an impeller, which blows the snow out of the machine through a chute. These two-stage snow blowers generally range from small standalone machines having a few horsepower, to accessories for a skid-steer machine to commercial grade large machines powered by hundreds of horsepower.

This aforementioned two-stage auger-impeller arrangement works fairly well for light, fluffy snow, however, it has drawbacks. One drawback is the impeller efficiency. The snow blower may be limited by the impeller flow rate because the impeller flow rate is a contributing factor to the volume of snow that may be moved during a given amount of time. The higher the impeller efficiency the faster the machine may be moved without getting clogged. A high impeller flow rate may also help keep the machine from getting clogged. In particular, when the impeller flow rate is less than the auger flow rate, the machine may become clogged.

Another drawback of conventional snow blowers is the packaging space that is required for the motor that drives the impeller. The impeller motor is generally arranged along a traveling axis of the machine, behind the housing that receives snow input (e.g., in between the inlet to receive snow and the operator of the machine). This location limits the ability to reduce the length of the machine along the traveling axis. The longer the length of the machine, the more difficult the machine is to maneuver, especially in tight spaces. In addition, a longer machine length may cause higher forces on components within the machine during operation.

The more efficient a snow blower machine is, the less power is needed to perform a particular job. In addition, inefficient snow blower machines may cause the operator to have to remove smaller sections of a bank of snow, make multiple passes, or slow the machine down to a crawl, all of which add considerable time to the snow removal process.

There is a need for snow removal apparatus that is able to convey snow from an area to be cleared in an efficient manner. There is a need for a snow blower machine with a more efficient impeller that facilitates blowing snow at a higher flow rate. There is also a need for a snow blower machine having a shorter length along a traveling axis to improve maneuverability and lower forces on components within the machine during operation.

One attempt to address the issue of snow removal is described in U.S. Pat. No. 3,468,041 to Mattson et. al., and issued on Sep. 23, 1969. The '041 patent describes a snow removal device including an impeller (e.g., auger) mounted in a housing between two end walls of the housing for rotation about an axis to expel snow. The snow removal device having an electric motor connected to rotate the impeller, and a sealed motor casing enclosing the motor and extending into the housing from one of the end walls. The casing being secured to one end wall.

Another attempt to address the issue of snow removal is described in U.S. Pat. No. 3,267,594, also to Mattson et al, and issued on Aug. 23, 1966. The '594 patent describes a snow removal device including a rotatable impeller mounted in an impeller housing and an electric motor and an elongated casing completely sealing the motor. The elongated casing having a substantial area in good heat exchange relationship with the impeller housing to cool the impeller housing and the motor.

The present disclosure is directed toward one or more of the problems set forth.

SUMMARY

In one aspect, the present disclosure relates to a snow blower machine including a first stage snow mover and a second stage snow mover. The first stage snow mover configured to receive snow from an inlet opening and to expel snow to a discharge opening. The second stage snow mover including an impeller chamber coupled to and extending from a snow receiving end proximate the discharge opening to a distal end rearward of the discharge opening. Disposed in the impeller chamber is an impeller including a hub having an inner diameter. The hub rotatable about an impeller axis to receive expelled snow from the first stage snow mover and deliver it to a second discharge opening. An impeller motor including a motor body may be configured to rotate the impeller, and the motor body defines a lateral cross-sectional dimension of the motor, and the motor body may be at least partially housed within the hub of the impeller. The inner diameter of the hub may be larger than the lateral cross-sectional dimension of the motor body, defined in a plane perpendicular to the impeller axis.

In another aspect, the present disclosure relates to a snow blower machine including a housing forming a snow receiving chamber. The housing may include a shroud extending from a first sidewall to a second sidewall opposite the first sidewall. An inlet opening of the housing may receive snow. The inlet opening may be located between the first and second sidewalls. A discharge opening may be located between the first and second sidewalls opposite the inlet opening. An auger mounted in the housing may be configured to receive snow from the inlet opening and to expel snow to the discharge opening. An impeller chamber may be configured to receive snow from the auger. The impeller chamber may extend from a snow receiving end proximate the discharge opening to a distal end rearward of the discharge opening. To receive expelled snow from the auger and deliver the snow to a second discharge opening, an impeller rotatable around an impeller axis at a hub may be disposed in the impeller chamber. The impeller may be rotated by an impeller motor having a motor body that is at least partially disposed within the hub. The snow blower machine may include a connection mechanism configured to couple the housing to a motive machine capable of traversing the machine across a ground surface.

In yet another aspect, the present disclosure relates to a snow blower machine including a housing forming a snow receiving chamber. The housing may include a shroud extending from a first sidewall to a second sidewall opposite the first sidewall. An inlet opening of the housing may receive snow. The inlet opening may be located between the first and second sidewalls. A discharge opening may be located between the first and second sidewalls opposite the inlet opening. An auger mounted in the housing may be configured to receive snow from the inlet opening and to expel snow to the discharge opening. An impeller chamber may be configured to receive snow from the auger. The impeller chamber may extend from a snow receiving end proximate the discharge opening to a distal end rearward of the discharge opening. To receive expelled snow from the auger and deliver to a second discharge opening, an impeller rotatable around an impeller axis at a hub may be disposed in the impeller chamber. The impeller may be rotated by an impeller motor having a motor body that is at least partially disposed within the hub, and the motor body extends forward of the distal end of the impeller chamber into the impeller chamber. The snow blower machine may include a connection mechanism configured to couple the housing to a motive machine capable of traversing the machine across a ground surface.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various examples discussed in the present document.

DETAILED DESCRIPTION

A snow blower is a machine that removes snow and throws or blows it to another location to move it out of the way. Although the type of snow blower machine illustrated in the examples is a two-stage snow blower accessory for attachment to a skid steer machine that provides a motive force to traverse the snow blower accessory across a ground surface, the snow blower machine may be any other type of snow blower. The snow blower machine may also include, for example, a standalone snow blower for household use. The snow blower accessory is shown primarily for illustrative purposes to disclose features of various examples.

In this disclosure, relative terms, such as, "rearward" or "forward" may be described with respect to the snow blower machine traveling in a working direction being the forward direction. In addition, the terms "rearward" or "forward may be described with respect to an auger or housing of the snow blower machine. For example, rearward of the auger may be defined as rearward of the auger when the snow blower machine is traveling in a working (e.g., forward) direction along a traveling axis.

In this disclosure, relative terms, such as, "substantially" are used to indicate a possible variation, for example, of ±10% in a stated numeric value.

Figure 1:
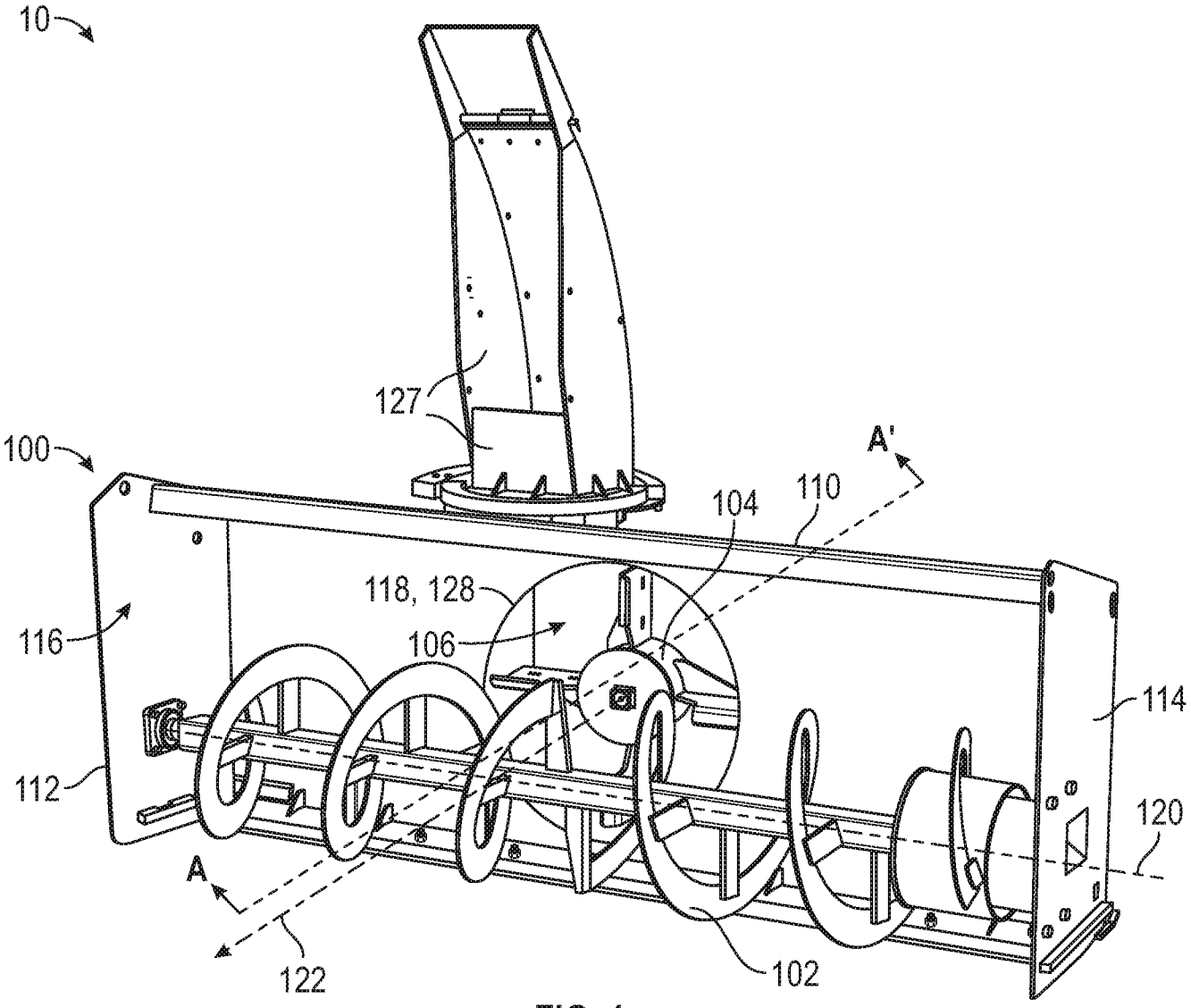
FIG. 1 is a front perspective view of an illustrative two-stage snow blower, in accordance with at least one example.

FIG. 1 illustrates an example snow blower machine 10 (hereinafter machine) for moving snow. The machine 10 may include a first stage including a housing 100 that forms a snow receiving chamber, and an auger 102 disposed in the housing 100. The second stage of the machine 10 may include an impeller 104 disposed in an impeller chamber 106 and rotated by an impeller motor 108 (FIGS. 3-7) to blow snow to a second discharge opening 126 (FIG. 3) and to a discharge chute 127 (FIGS. 1 and 3) for removal out and away from the machine 10.

In an example first stage, the housing 100 may include a shroud 110, a first sidewall 112, a second sidewall 114, an inlet opening 116 configured to receive snow. The housing 100 may also include a discharge opening 118 configured to discharge snow to the second stage (e.g., the impeller chamber 106). The shroud 110 may extend from a first sidewall 112 to a second sidewall 114 opposite the first side wall 112. The inlet opening 116 may be located between the first and second sidewalk 112, 114. The discharge opening 118 may be configured to deliver snow to the second stage, which in an example may include the impeller 104 in the impeller chamber 106. The impeller chamber 106 may receive snow from the housing 100 at a location between the first and second sidewalls 112, 114 opposite the inlet opening 116.

The auger 102, configured to receive snow from the inlet opening 116 and to expel snow to the discharge opening 118, may be disposed in and coupled to the housing 100. In some examples, the auger 102 (e.g., at least a portion of the auger) may be mounted in between the first and second sidewalls 112, 114. The auger 102 may be rotatable about an auger axis 120. The auger axis 120 may be perpendicular (e.g., substantially perpendicular) to a traveling axis 122 along which the machine 10 travels when moving in a working direction. In some examples, the machine 10 is self-propelled. In other examples, the machine 10 may include one or more connection mechanism(s) (124, FIG. 6, 125, FIG. 7) that are configured to couple the machine 10 (e.g., snow blower machine, snow blower accessory) to a motive machine that provides a motive force. Such a motive machine may be capable of traversing the machine 10 across a ground surface. An example of such a motive machine may include a skid steer machine or various types of tractors that may be coupled to a snow blower machine accessory (e.g., the machine). In some examples, the motive machine may be a chassis, wheels and motor of a standalone snow blower machine.

Figure 3:
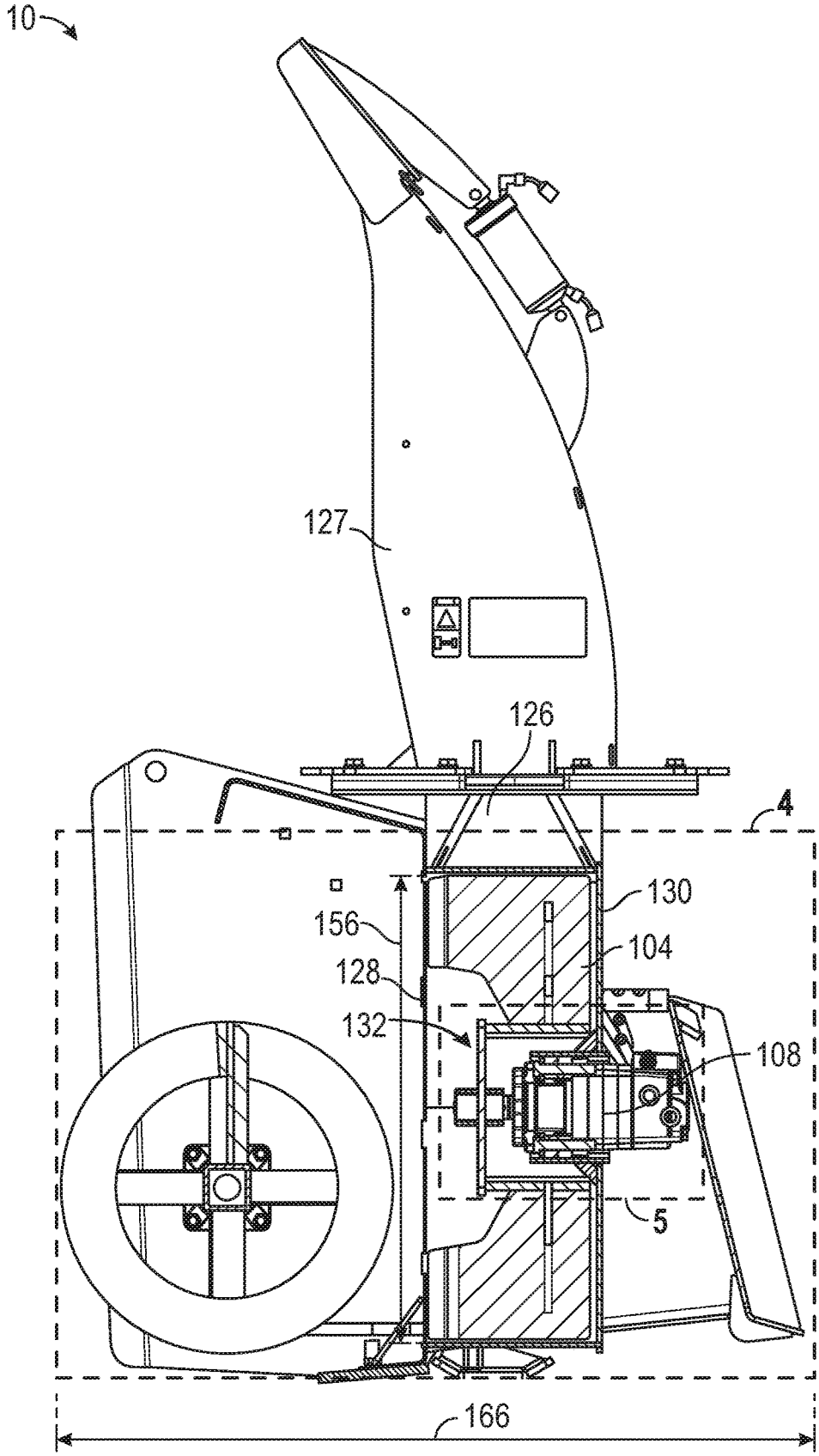
FIG. 3 is a cross-sectional side view of the snow blower of FIG. 1 taken along line A-A', in accordance with at least one example.

In an example second stage, the impeller 104 may be disposed in (e.g., disposed at least partially within) the impeller chamber 106. The impeller 104 may be rotated to receive expelled snow from the auger 102 and to deliver it to a second discharge opening 126 (FIG. 3). The impeller chamber 106 may extend from a snow receiving end 128

(FIGS. 1 and 4) proximate the discharge opening 118, to a distal end 130 (FIG. 4) rearward and opposite of the snow receiving end 128.

Figure 2:
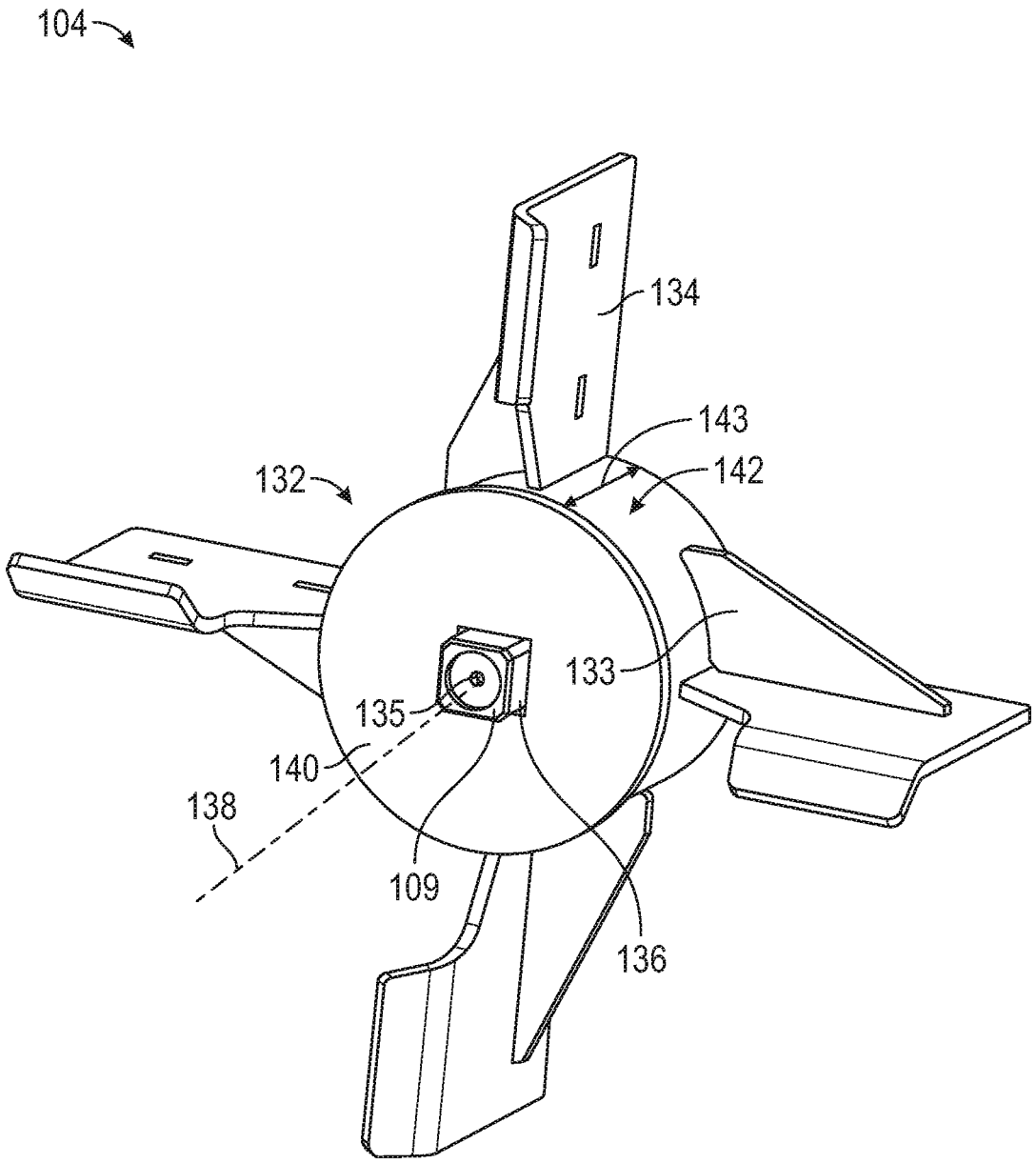
FIG. 2 is a front perspective view of an impeller and spindle end of a motor of the snow blower of FIG. 1, in accordance with at least one example.

FIG. 2 shows the example impeller 104 of FIG. 1 in further detail. The impeller 104 may include a hub 132 and one or more blades 134 extending outward from the hub 132. To provide a rotational motion to the impeller 104, the impeller 104 may be coupled to a spindle 109 of the impeller motor 108 (FIGS. 3-7) at a spindle-hub connection 136. The spindle-hub connection 136 may be located proximate a center 135 of the hub 132. The center 135 of the hub 132 may include a central portion of the hub 132 proximate and/or surrounding the center 135 as shown in FIG. 2.

The impeller motor 108 (FIGS. 3-7) may rotate the impeller 104 about an impeller axis 138 that is perpendicular to the auger axis 120 and/or parallel to (substantially parallel to) the traveling axis (FIG. 1).

In some examples, the impeller 104 may include reinforcement members 133 disposed between the blades 134 and the hub 132 to strengthen the blades 134 and to reduce bending and vibration of the blades 134 during use.

The hub 132 may include a hub end 140 and motor housing wall 142 extending rearward from the hub end 140 forming a motor housing that may be configured to surround at least portion of motor 108. In some examples, the motor housing wall 142 may include a cylindrical wall having a length 143 extending rearward from the hub end 140 along the impeller axis 138.

Figure 4:
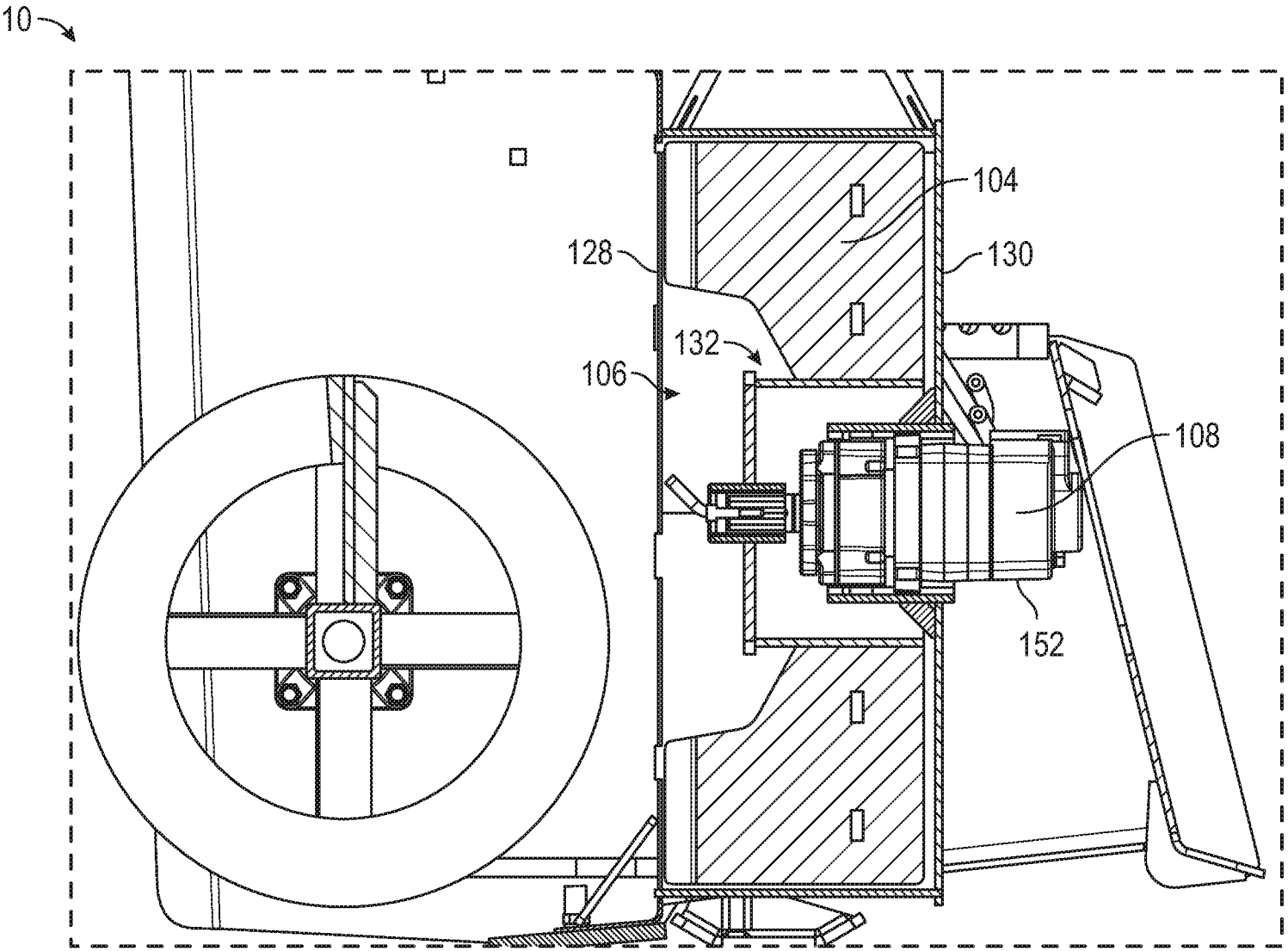
FIG. 4 is a close-up view showing a portion of the cross-sectional view of the snow blower of FIG. 3, in accordance with at least one example.
Figure 5:
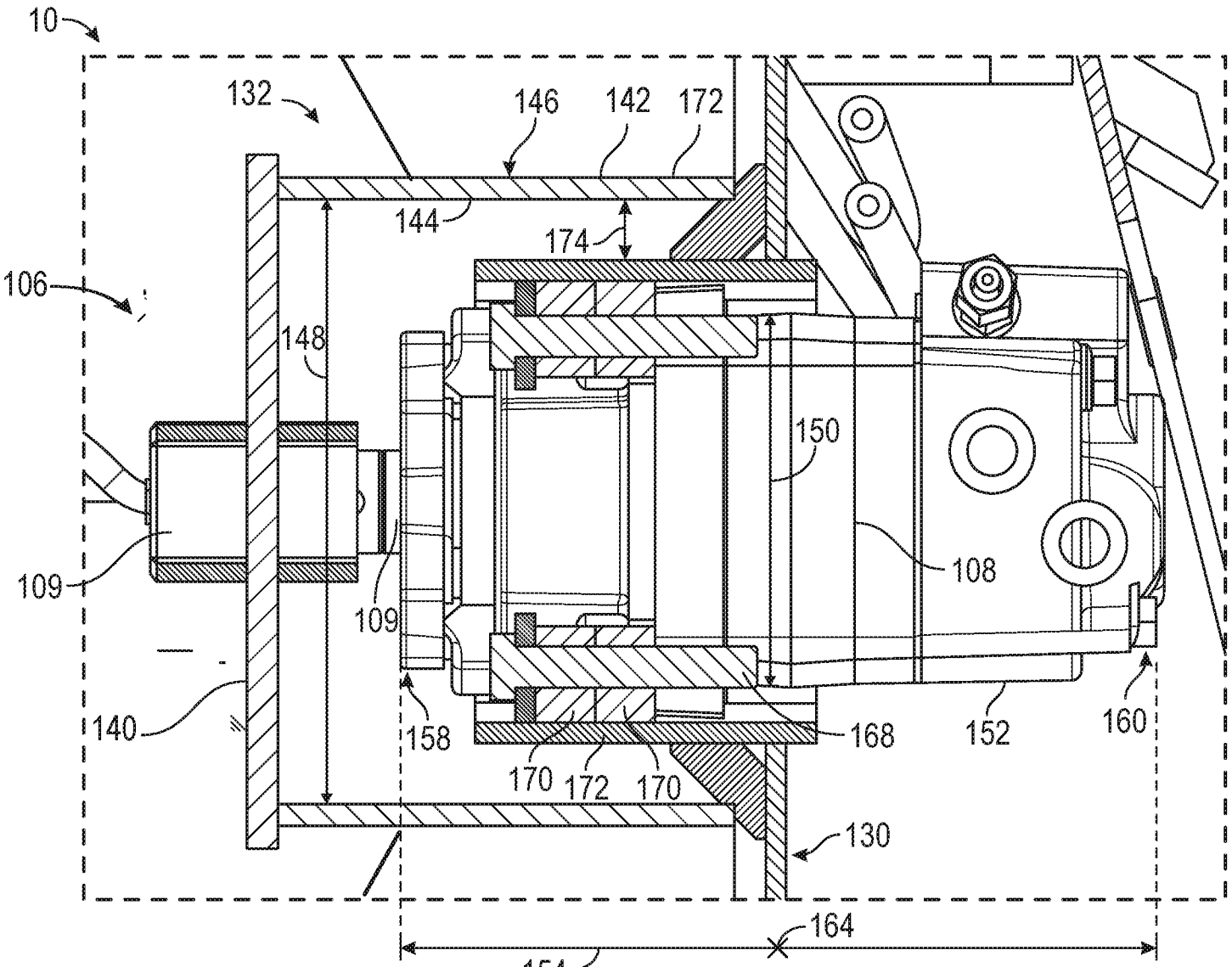
FIG. 5 is a further close-up view showing a portion of the cross-sectional view of the snow blower in FIGS. 3 and 4, in accordance with at least one example.

FIG. 3 shows an overall cross-sectional side view of the snow blower of FIG. 1 taken along line A-A', in accordance with at least one example. FIGS. 4 and 5 show additional close-up views of FIG. 3.

As shown in FIGS. 3-5, and in particularly shown in the close-up view of FIG. 5, the hub 132 may have an inner surface 144 facing a motor body 152 of the motor 108, and an outer surface 146 facing the impeller chamber 106. The outer surface 146 being opposite the inner surface 144 forming a thickness of the hub 132 therebetween. The hub 132 may include an inner diameter 148. The inner diameter 148 may be larger than a lateral cross-sectional dimension 150 of the motor body 152. For example, at one or more specified planes perpendicular to the impeller axis 138, the inner diameter 148 of the hub 132 may be larger than the lateral cross-sectional dimension 150 of the motor body 152. In some examples, the inner diameter 148 of the hub 132 is larger than the lateral cross-sectional dimension 150 of the motor body 152 along a length 154, a specified length or the entire length of the impeller motor 108 that the hub 132 surrounds.

As shown in FIG. 3, the impeller 104 may have an impeller diameter 156. The impeller diameter 156 may be larger than the inner diameter 148 of the hub 132. In one or more planes perpendicular to the impeller axis, the inner diameter 148 of the hub 132 may be at least 20%, or in a range between 20-80% of the impeller diameter 156. In a possibly more preferred example, depending on desired characteristics of the machine 10, the inner diameter 148 may be at least 30%, or in a range between 30 to 70% of the impeller diameter 156.

As shown in FIGS. 3-7, the impeller motor 108 may include a motor body 152 (FIGS. 4 and 5) that encloses components of the motor 108. As shown in FIG. 5, the motor body 152 may extend from a spindle end 158 proximate the rotatable spindle 109, to a distal motor end 160 configured to receive hydraulic connections (e.g., 162, FIG. 7). As shown in FIGS. 3-5, the motor body 152 may be at least partially disposed (e.g., housed) in the impeller chamber 106 and/or within the hub 132 of the impeller 104. For example, the hub end 140 of the hub 132 may be coupled to the spindle 109 of the motor 108 at the center 135 of the hub 132 (also see, FIG. 2), and the motor housing wall 142 (FIG. 5) may form a motor housing around (e.g., surrounding, at least partially surrounding, enclosing) at least a portion of the motor body 152. In some examples, at least a portion of the motor body 152 may extend forward of the distal end 130 of the impeller chamber 106 into the impeller chamber 106.

As shown in FIG. 5, the spindle end 158 of the motor body 152 may be disposed in the impeller chamber 106. In some examples, the motor 108 may include a spindle 109 that extends forward of the motor body 152, and both the rotatable spindle 109 and the stationary spindle end 158 of the motor body 152 may be disposed in the impeller chamber 106. In some examples, the motor 108 may be coupled by one or more fasteners 168 and one or more isolators 170 to one or more motor mounts 172. In some examples, the motor mounts 172 may be disposed between the motor body 152 and the inner surface 144 of the hub 132. In some example the isolators 170 may be disposed between the motor body 152 and the motor mount 172. A gap 174 may be present between the motor mount 172 and the inner surface 144 of the hub 132 to allow the impeller 104 to freely rotate about the motor body 152 and the motor mount 172.

In some examples, at least 10% or 10-90% of the length 154 of the motor body 152 may be disposed in the impeller chamber 106 and/or hub 132. In a possibly more preferred example, depending on desired characteristics of the machine 10, at least 25% or 25-75% of the motor body 152 may be disposed in the impeller chamber 106 and/or hub 132. In a yet more preferred example, at least 30%, or 30-65% of the motor body 152 may be disposed in the impeller chamber 106 and/or hub 132. One benefit of having at least a portion of the motor body 152 disposed in the impeller chamber 106 and/or hub 132 is that longitudinal packaging space of the overall machine 10 may be reduced.

In some examples, it may be favorable to maintain a portion of the motor body 152 including hydraulic connections (e.g., 162, FIG. 7) rearward of the impeller chamber 106 in order to provide access to connect hydraulic hoses 162 to the motor 108. In some examples, 100% of the length of the motor 108 may be disposed in the impeller chamber 106 and/or hub 132.

As shown in FIG. 5, in some examples, the motor body 152 may be supported along a mid-portion of the motor body 152. The mid-portion may be located between the spindle end 158 and the distal motor end 160. In some examples, the mid-portion extends along 75% of the length 154 of the motor body 152 centered around a longitudinal mid-point 164. In a possibly more preferred example, the mid-portion extends along 50% of the length of the motor body 152 centered around the longitudinal mid-point 164. In some examples, at least portion of the motor body 152 extends into the impeller chamber such that that the motor body is supported in a cantilevered manner proximate the mid-portion.

Figure 6:
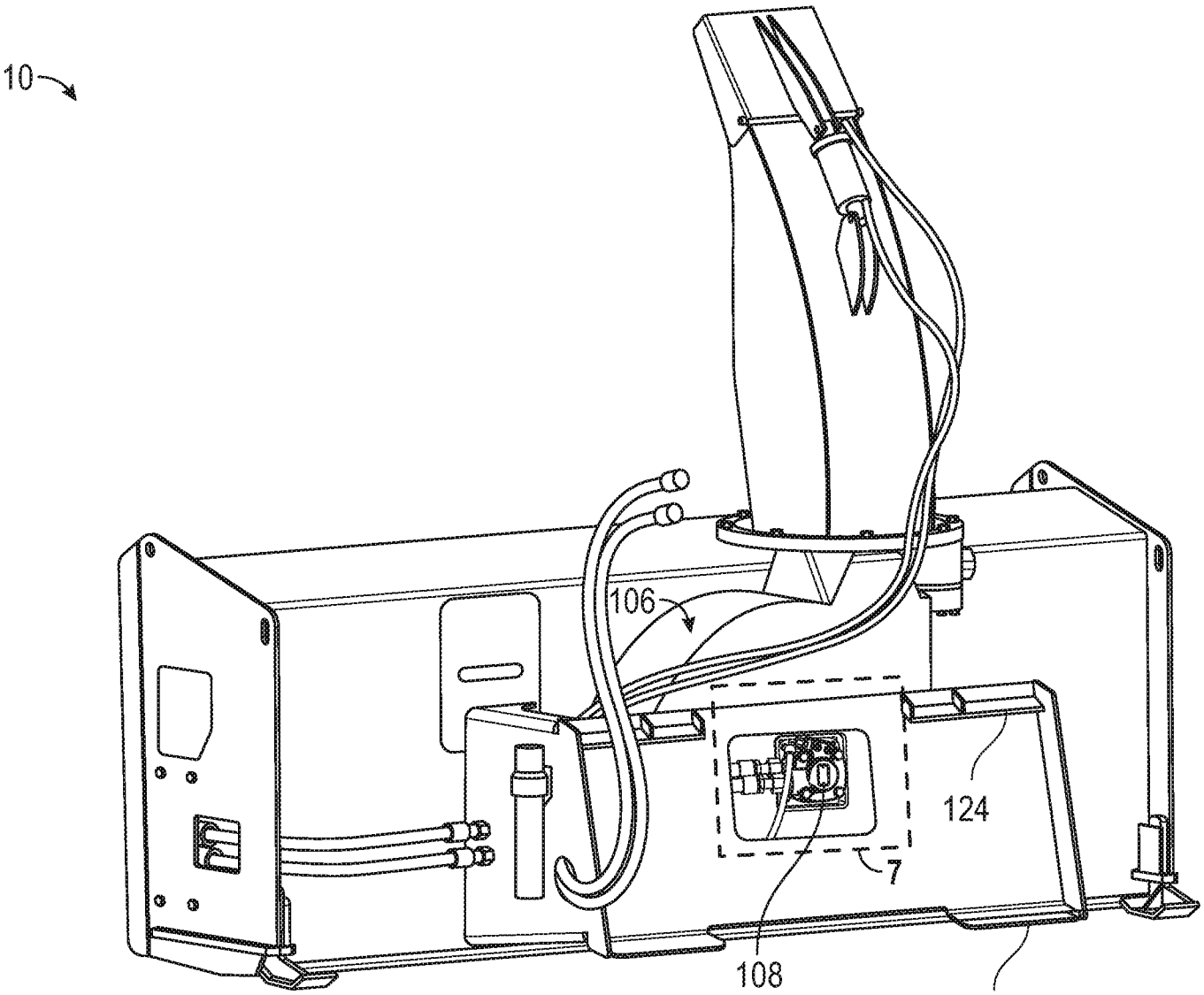
FIG. 6 is a rear perspective view of the snow blower of FIG. 1, in accordance with at least one example.
Figure 7:
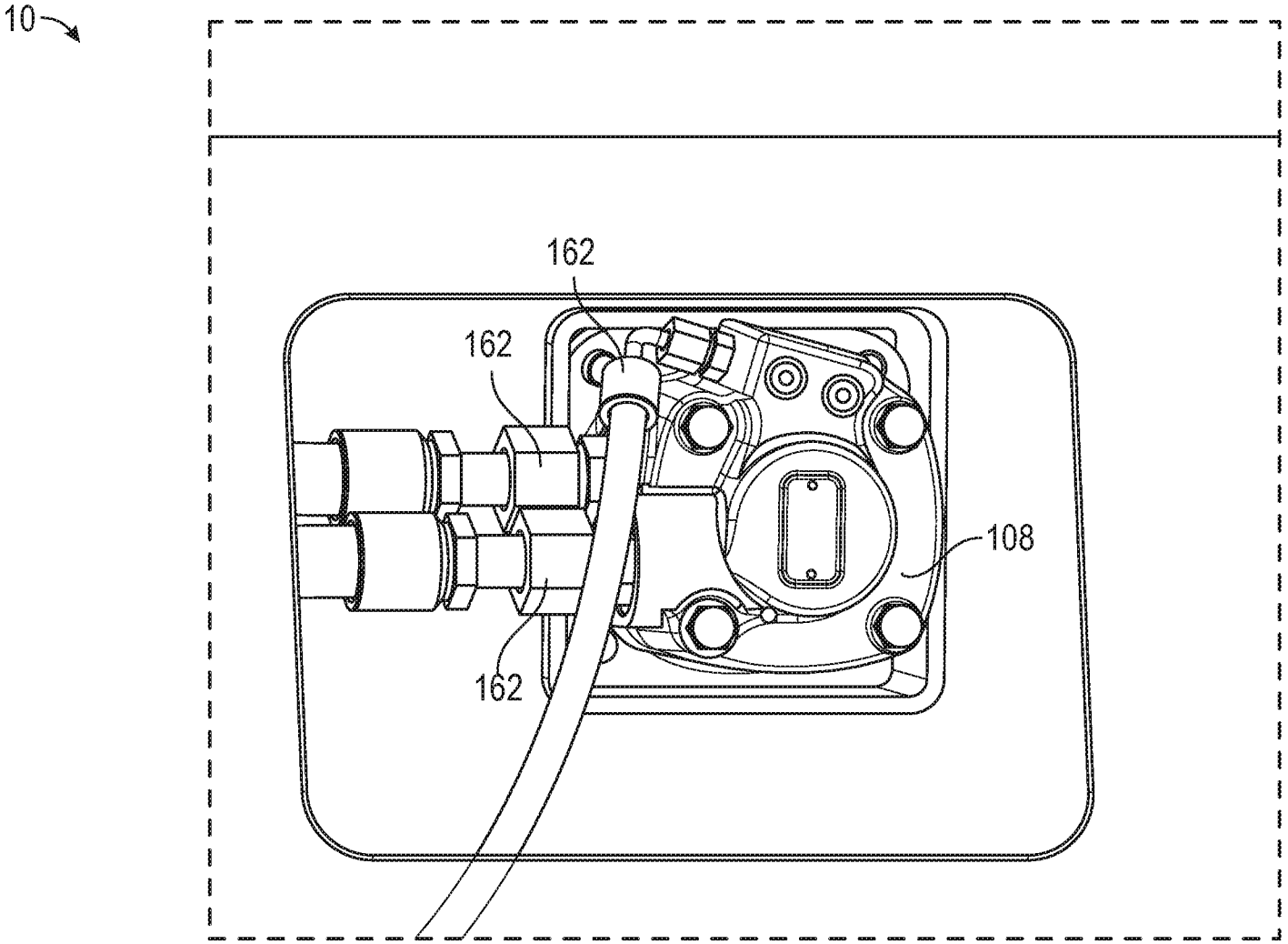
FIG. 7 is a close-up view showing a portion of the rear perspective view of the snow blower of FIG. 6, in accordance with at least one example.
Figure 8:
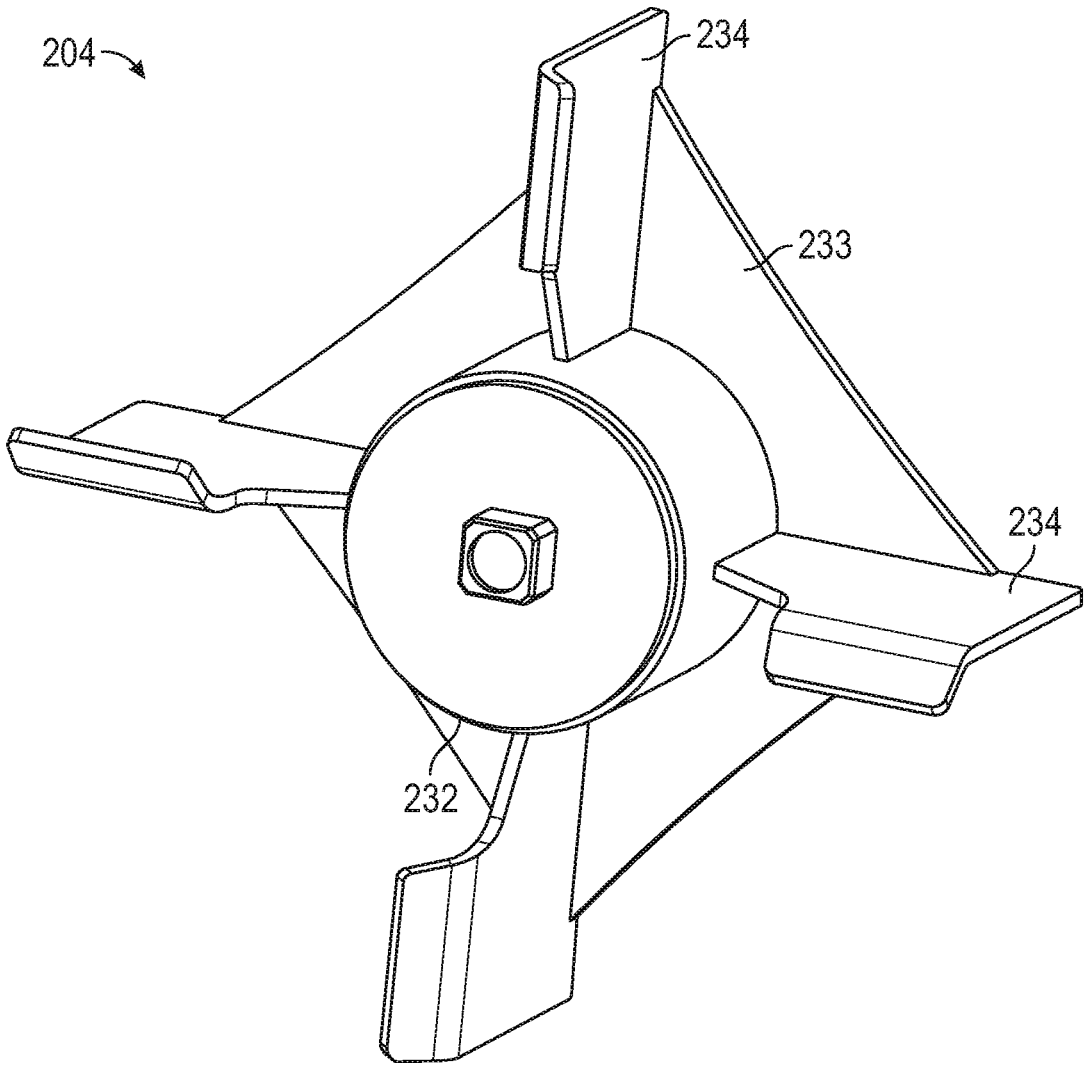
FIG. 8 is a front perspective view of another impeller, in accordance with at least one example.

FIG. 6 and the close-up view of FIG. 7 show rear perspective views of the machine 10 of FIG. 1, in accordance with at least one example. FIGS. 6 and 7 illustrate a portion of the motor 108 including the distal motor end 160 and hydraulic connections 162, FIG. 7) extending rearward of the impeller chamber 106 (FIG. 6).

FIG. 7 shows another illustrative impeller 204 design that may be used in the machine 10 of FIG. 1. The impeller 204 may include reinforcement members 233 that extend between the blades 234, connecting them to each other and to the hub 232. The reinforcement members 233 may strengthen the impeller 204 and reduce vibration during use.

One of the benefits of the machine 10 including the example impellers 104, 204 described herein is that they may be capable of improved snow flow rates over conventional impellers. The impellers 104, 204 described herein provide unexpected results over conventional impellers that minimize the hub of the impeller to improve flow rate. However, the hub 132, 232 design, size and shape as described herein has been discovered to produce beneficial results. For example, one benefit is that the flow rate of the impeller 104, 204 can be increased. Another benefit is that the motor body 152 can be housed at least partially within the hub 132, which results in a reduced length of the combination of the motor 108 and the impeller 104, 204 along the traveling axis 122 of the machine 10 (FIG. 1), as well as a reduced length (FIG. 3) of the overall machine 10. Reducing the machine 10 length 166 (FIG. 3) may improve maneuverability, shipping constraints, and reduce floor space needed for displaying the machine 10. Yet another benefit can include mounting the motor body 152 at least partially within the hub may even out the loads on the motor 108, which may lead to increased motor life. In particular, the arrangement of the motor 108 within the hub 132 and support of the motor 108 along a mid-portion of the motor 108 reduces the bending stress on bearings in the motor 108.

In simulation computer models run using various impeller designs (such as 104 and 204) according to the examples described herein, the impellers 104, 204 produced unexpected flow rates that were about 100 to 300% better than corresponding conventional impellers having a small hub that did not house any portion of the motor body 152 within the hub 132.

INDUSTRIAL APPLICABILITY

In general, the foregoing disclosure finds utility in various industrial applications, such as, in snow blower machine accessories or attachments to a skid steer loader, but may also find utility in standalone snow blowers. The impellers 104, 204 described herein may provide for improved flow rate of snow out of the impeller 104, 204. The operation of the snow blower machine 10 will now be described.

During normal operation of the machine 10, in a first stage, housing 100 forms a snow receiving chamber that receives snow into inlet opening 116 of shroud 110 extending from first side wall 112 to second sidewall 114 opposite first sidewall 112. Auger 102 mounted in the housing 100 between first and second sidewalls 112, 114 and opposite the inlet opening 116 rotates to move received snow to discharge opening 118.

In a second stage, impeller 104 including hub 132 and disposed in impeller chamber 106 receives snow from auger 102 at snow receiving end 128. Impeller 104, rotated by impeller motor 108 at least partially disposed in hub 132, moves snow from snow receiving end 128 to second discharge opening 126.

Locating at least a portion of motor body 152 of impeller motor 108 within hub 132 of the impeller 104 may provide an improved flow rate of snow exiting the impeller 104. Locating the impeller motor 108 as described may also reduce undesirable forces on the motor 108, including reducing bending stresses on bearings inside the motor 108.

It will be apparent to those skilled in the art that various modifications and variations can be made to the disclosed snow blower machine. Other embodiments will be apparent to those skilled in the art from consideration of the specification and the practice of the disclosed machine. It is intended that the specification and examples be considered as exemplary only, with a true scope being indicated by the claims and their equivalents.

What is claimed is:

1. A two-stage snow blower machine comprising:

a first stage configured to receive snow from an inlet opening and to expel the snow to a discharge opening; and a second stage comprising:

an impeller chamber extending from a snow receiving end proximate the discharge opening to a distal end rearward of the discharge opening, the impeller chamber including a second discharge opening; and an impeller disposed in the impeller chamber, the impeller having a hub that is rotatable about an impeller axis, the impeller configured to receive expelled snow from the first stage and deliver the snow to the second discharge opening, and wherein the hub includes a hub end facing the discharge opening of the first stage and a hub wall extending perpendicularly rearward from the hub end defining an enclosed cylindrical motor housing with a plurality of impeller blades extending outward from an outer surface of the motor housing and attached at a first end directly to the outer surface of the cylindrical motor housing; and a motor configured to rotate the impeller, the motor including a motor body at least partially housed within the enclosed cylindrical motor housing;

wherein the first end of the impeller blades is at a height that is beyond an outer surface of the motor body.

2. The machine of claim 1, wherein the hub has an inner surface and wherein the inner surface of the hub defines an inner diameter of the motor housing, and wherein the motor body defines a lateral cross-sectional dimension, and wherein the inner diameter of the motor housing is larger than the lateral cross-sectional dimension of the motor body in a plane perpendicular to the impeller axis.

3. The machine of claim 2, wherein the impeller defines an impeller diameter, and wherein the hub surrounds at least a portion of the motor body, and wherein the inner diameter of the hub is at least 25% of the impeller diameter in a plane perpendicular to the impeller axis.

4. The machine of claim 2, wherein the motor body is coupled to a motor mount, and wherein the motor mount is disposed between the motor body and the inner surface of the hub.

5. The machine of claim 1, wherein the motor body extends forward of the distal end of the impeller chamber.

6. The machine of claim 1, wherein the motor body has a length that extends from a spindle end to a distal end opposite the spindle end, and wherein at least 25% of the length of the motor body extends into the hub.

7. The machine of claim 1, further comprising a connection mechanism configured to couple the machine to a motive machine capable of traversing the machine across a ground surface.

8. The machine of claim 1, wherein the motor includes a spindle extending forward of the motor body, wherein the spindle is coupled to the hub to rotate the impeller, and wherein the motor body has a length that extends from a spindle end proximate the spindle to a distal end opposite the spindle end, and wherein the spindle and the spindle end of the motor body are disposed in the impeller chamber.

9. The machine of claim 1, wherein the first stage comprises:

a housing forming a snow receiving chamber, the housing including a shroud extending from a first sidewall to a second sidewall opposite the first sidewall, wherein the inlet opening is located between the first and second sidewalls, and wherein the discharge opening is located between the first and second sidewalls opposite the inlet opening; and an auger disposed in the housing between the first and second sidewalls, the auger rotatable about an auger axis, the auger configured to receive snow from the inlet opening and to expel snow to the discharge opening.

10. The machine of claim 9, wherein the auger axis and the impeller axis are arranged perpendicular to one another.

11. A snow blower machine comprising:

a housing forming a snow receiving chamber, the housing including:

a shroud extending from a first sidewall to a second sidewall opposite the first sidewall;

an inlet opening to receive snow, the inlet opening located between the first and second sidewalls; and a discharge opening to discharge snow, the discharge opening located between the first and second sidewalls opposite the inlet opening;

an auger mounted in the housing between the first and second sidewalls, the auger rotatable about an auger axis, the auger configured to receive snow from the inlet opening and to expel snow to the discharge opening;

an impeller chamber to receive snow from the auger, the impeller chamber extending from a snow receiving end proximate the discharge opening to a distal end rearward of the discharge opening;

an impeller disposed in the impeller chamber, the impeller having a hub that is rotatable about an impeller axis to receive expelled snow from the auger and deliver the snow to a second discharge opening;

a motor having a motor body, wherein the motor is configured to rotate the impeller, and wherein the motor body is at least partially disposed within the hub, wherein one or more motor mounts extend from the distal end of the impeller chamber into the impeller chamber and within the hub, the motor body being mounted to the one or more motor mounts such that the motor mounts are located between the motor body and an inner surface of the hub, and wherein at least a portion of the motor body extends into the impeller chamber and the motor body is supported at a mid-portion in a cantilevered manner with at least 50% of a length of the motor body within the hub; and a connection mechanism configured to couple the housing to a motive machine capable of traversing the machine across a ground surface.

12. The machine of claim 11, wherein the hub has an inner diameter, and wherein the motor body defines a lateral cross-sectional dimension, and wherein the inner diameter of the hub is larger than the lateral cross-sectional dimension of the motor body in a plane perpendicular to the impeller axis.

13. The machine of claim 11, wherein at least a portion of the motor body extends forward of the distal end of the impeller chamber.

14. The machine of claim 11, wherein the motor includes a spindle extending forward of the motor body, wherein the spindle is coupled to the hub to rotate the impeller, and wherein the motor body has a length that extends from a spindle end proximate the spindle to a distal end opposite the spindle end, and wherein the spindle and the spindle end of the motor body are disposed in the impeller chamber.

15. The machine of claim 11, wherein the hub has an inner diameter and wherein the hub surrounds at least a portion of the motor body, wherein the impeller has an impeller diameter, and wherein the inner diameter is at least 25% of the impeller diameter in a plane perpendicular to the impeller axis.

16. A two-stage snow blower machine comprising:

a housing comprising:

a shroud extending from a first sidewall to a second sidewall opposite the first sidewall;

an inlet opening to receive snow, the inlet opening located between the first and second sidewalls; and a discharge opening to discharge snow, the discharge opening located between the first and second sidewalls opposite the inlet opening;

an auger mounted in the housing between the first and second sidewalls, the auger rotatable about an auger axis, the auger configured to receive snow from the inlet opening and to expel snow to the discharge opening;

an impeller chamber extending from a snow receiving end proximate the discharge opening to a distal end rearward of the discharge opening;

an impeller disposed in the impeller chamber, the impeller having a hub that is rotatable about an impeller axis to receive expelled snow from the auger and deliver the snow to a second discharge opening, wherein the hub includes a hub end facing the discharge opening of the first stage and a hub wall extending perpendicularly rearward from the hub end defining an enclosed cylindrical motor housing with a plurality of impeller blades extending outward from an outer surface of the motor housing and attached at a first end directly to the outer surface of the cylindrical motor housing; and a motor including a motor body, wherein the motor body is configured to rotate the impeller, and wherein the motor body is at least partially disposed within the enclosed cylindrical motor housing of the hub, and wherein the motor body extends forward of the distal end of the impeller chamber into the impeller chamber;

wherein the first end of the impeller blades is at a height that is beyond an outer surface of the motor body.

17. The machine of claim 16, wherein the hub has an inner diameter, and wherein the motor body defines a lateral cross-sectional dimension, and wherein the inner diameter of the hub is larger than the lateral cross-sectional dimension of the motor body in a plane perpendicular to the impeller axis.

18. The machine of claim 16, wherein the motor body has a length that extends from a spindle end to a distal end opposite the spindle end, and wherein at least 25% of the length of the motor body extends into the hub.

* * * * *